US008511938B1

(12) United States Patent
Payne et al.

(10) Patent No.: US 8,511,938 B1
(45) Date of Patent: Aug. 20, 2013

(54) FLOOD FLAPS VENT FOR SEALED CRAWLSPACE

(76) Inventors: Christopher Kimpton Payne, Mt. Pleasant, SC (US); Jothem Nevers Jayne, Johns Island, SC (US); George Kimpton Payne, Jr., Mt. Pleasant, SC (US)

( * ) Notice: Subject to any disclaimer, the term of this patent is extended or adjusted under 35 U.S.C. 154(b) by 0 days.

(21) Appl. No.: 13/385,399

(22) Filed: Feb. 17, 2012

(51) Int. Cl.

| | |
|---|---|
| ***E02B 7/20*** | (2006.01) |
| ***E02B 7/00*** | (2006.01) |
| ***E02B 8/00*** | (2006.01) |
| ***E02B 7/26*** | (2006.01) |

(52) U.S. Cl.
USPC ..... 405/93; 405/87; 405/92; 405/103; 405/104; 52/302.1; 52/741.3; 160/123; 160/330; 454/275

(58) Field of Classification Search
USPC ..... 405/87, 92, 93, 103, 104; 52/302.1, 52/741.3; 160/123, 330; 454/275
See application file for complete search history.

(56) References Cited

U.S. PATENT DOCUMENTS

| | | | | |
|---|---|---|---|---|
| 2,105,735 | A | 1/1938 | Hodge | |
| 2,758,646 | A * | 8/1956 | Johnson | 160/354 |
| 2,774,166 | A | 12/1956 | Wolverton | |
| 4,103,497 | A | 8/1978 | Colamussi et al. | |
| 4,469,018 | A | 9/1984 | Taulman | |
| 5,020,567 | A | 6/1991 | Proulx | |
| 5,444,947 | A | 8/1995 | Miller | |
| 5,496,213 | A | 3/1996 | Miller | |
| 5,944,445 | A * | 8/1999 | Montgomery | 405/92 |
| 6,691,643 | B1 | 2/2004 | Hollins | |
| D493,880 | S * | 8/2004 | Achen | D23/388 |
| 7,040,979 | B1 | 5/2006 | Betz | |
| 7,270,498 | B1 * | 9/2007 | Albanese | 405/104 |
| 7,600,944 | B1 | 10/2009 | Keating | |
| 8,308,396 | B2 | 11/2012 | Shook | |
| 2003/0024865 | A1 | 2/2003 | Kezele et al. | |
| 2005/0039694 | A1 | 2/2005 | Johnson | |
| 2005/0050833 | A1 | 3/2005 | Spray | |
| 2005/0113019 | A1 | 5/2005 | Kutschman | |
| 2005/0284402 | A1 | 12/2005 | Becker | |
| 2006/0179719 | A1 | 8/2006 | Christie | |
| 2008/0184625 | A1 * | 8/2008 | Bjorholm et al. | 49/371 |
| 2008/0236062 | A1 | 10/2008 | Bergaglio | |
| 2010/0086358 | A1 | 4/2010 | Haryslak | |
| 2011/0182669 | A1 | 7/2011 | Shook | |
| 2011/0225892 | A1 | 9/2011 | Tierney | |

* cited by examiner

*Primary Examiner* — Thomas Beach
*Assistant Examiner* — Edwin Toledo-Duran

(57) ABSTRACT

A flood flaps vent for sealing a building crawlspace includes: (a) a vent box portion including open opposite front and rear ends on either end of a vent passageway, the vent box including a top box portion with at least one flap slot adjacent a rear end portion of the vent box, and an opposite bottom box portion; (b) at least one flexible flood flap extending across the open rear end portion, with its upper edge seated in the flap slot, other side flap edges of the flood flap being unattached; and (c) a grate portion over the open front end portion of the vent box; the flood flap occluding the rear end portion of the vent box when it is in an at rest, home position. This simplified abstract is not intended to limit, and should not be interpreted as limiting, the scope of the claims.

20 Claims, 9 Drawing Sheets

FLOOD FLAPS VENT FOR SEALED CRAWLSPACE

BACKGROUND OF THE INVENTION

1. Technical Field

The present invention relates to a crawlspace vent with flood flaps that permit flood waters to pass in and out of a sealed crawlspace under a building in the event of a flood, yet inhibit air flow through the sealed crawlspace the rest of the time.

2. Background Information

Many builders and homeowners in the last decade are realizing the advantages of sealing the crawlspace under their new construction, or converting the crawlspace under an existing building to a sealed crawlspace. With dehumidifiers operating in the crawlspace, usually under the control of a humidistat, such advantages include reduced humidity and a relatively constant temperature in the crawlspace, which result in lower heating and cooling bills for the building, reduced mold, fungus, and mildew under the building, and fewer problems from small animals entering through the crawlspace. Conventional air vents are disadvantageous with a sealed crawlspace, because dehumidifiers under the building will not work as well with an influx of humid outside air entering the crawlspace through conventional air vents.

However, houses and other buildings built in a flood-prone area require some sort of crawlspace venting to prevent the building walls from weakening or collapsing during a flood event. Without vents that permit flood waters to flow in and out of the crawlspace under a building, hydrostatic pressure in the crawlspace can reach a break point beyond which the building walls may crumble. It has therefore been impossible to seal a crawlspace in a building on a flood plain heretofore while complying with government rules and regulations. Up to this point, there have not been any cost-effective vents that obstruct air flow completely and provide insulation, yet allow water to flow into and out of a sealed crawlspace.

Buildings located in areas where flooding is a possibility are generally required to have vents in the walls of their crawlspaces to allow flood waters to flow in to and out of the crawlspace in order to relieve hydrostatic pressures that could destroy the integrity of the walls. In all buildings with crawlspaces, whether in a flood zone or not, crawlspace vents are used to allow air flow to avoid dampness under the building, which can cause rotting, insect infestation, moisture buildup, etc. The new sealed crawlspace can be installed as a building is being constructed or retroactively. The sealed crawlspace provides a dry, clean and heating and air conditioning efficient building. The flood flaps vent 10 opens to permit the flow of water in or out of the building when the water level outside (or inside) the building rises, thereby avoiding an excessive pressure differential to develop between the interior and exterior of the building, as well as damage or failure of the building while maintaining a sealed vent when high water conditions do not exist.

Rules and regulations now require buildings with enclosed spaces located below defined flood plain levels to include automatic equalization of interior and exterior hydrostatic pressure caused by flood waters. The rules and regulations require buildings to be designed and built to allow flood water to move in and out of a building freely. Unfortunately, the vents developed for flood purposes cannot provide the insulated and sealed conditions required by sealed crawlspace technology. A number of devices have been developed to reduce or eliminate the pressure differential that may develop between the interior and exterior of a building.

The flood flaps vent of the present invention maintains a sealed crawlspace environment by blocking air flow through the vent, yet permitting water to flow in and out of the crawlspace freely during a high water event. In a building with flood flaps vents, hydrostatic pressure does not reach a break point and structural integrity of the building is maintained.

BRIEF SUMMARY OF THE INVENTION

The present invention is a vent with flood flaps for sealing a crawlspace under a building. The flood flaps vent comprises: (a) a vent box portion including open opposite front and rear ends on either end of a vent passageway in the vent box portion, the vent box portion comprising a top box portion, an opposite bottom box portion, and two side wall portions, the top box portion comprising at least one flap slot adjacent a rear end portion of the vent box portion; (b) at least one flexible flood flap extending across the open rear end portion of the vent box portion, an upper edge of the flexible flood flap being seated in the correspondingly sized flap slot in the top box portion, other side flap edges of the flood flap being unattached; and (c) a grate portion over the open front end portion of the vent box portion. The flood flap substantially occludes the rear end portion of the vent box portion when the flood flap is in an at rest, home position Advantages of the flood flaps vent of the present invention include the following: 1) allows building crawlspaces of buildings in flood plains to be air sealed yet comply with state and federal codes for crawlspace flood venting; 2) allows the homeowner to control humidity while minimizing the threat of loss of integrity of the building walls in the event of a flood; 3) the grate portion on the front of the flood flaps vent presents an aesthetically pleasing appearance to passers by, helps deter vandalism, and keeps out animals and other vermin; 4) double flaps in each flood flaps vent help maintain the house's thermal insulation throughout the sealed crawlspace; 5) the passageway interior of the flood flaps vent is sized to help prevent flood water from flowing between the layers of the building walls (e.g., block and brick) and causing water damage; and 6) the flood flaps vent is economical, especially when compared to the costs for flood damage that may occur if it is not employed.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
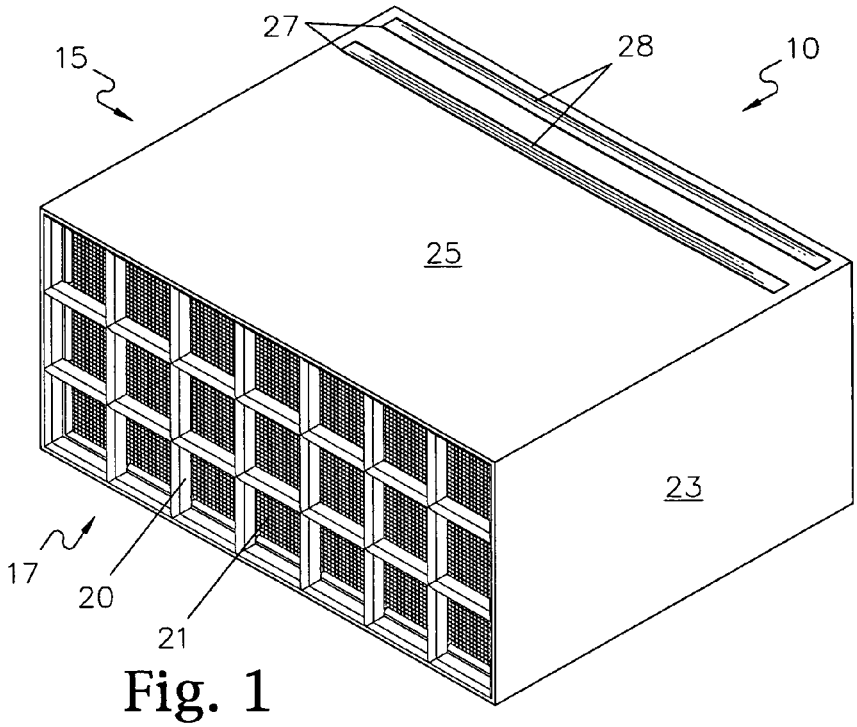
FIG. 1 shows a front perspective view of a flood flaps vent according to the present invention.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, a device embodying the principles and concepts of the present invention and generally designated by the reference numeral 10 will now be described.

Figure 2:
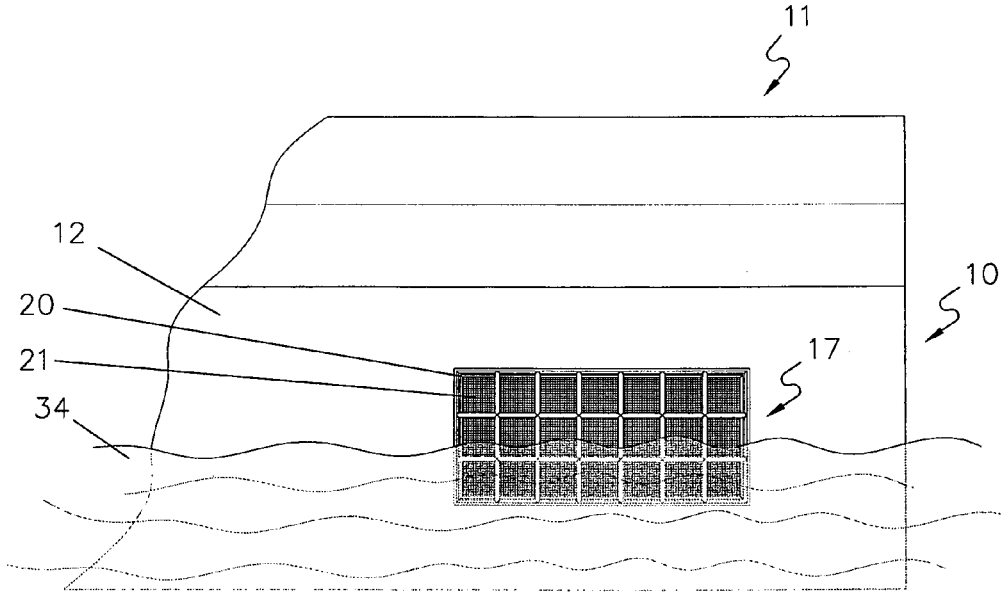
FIG. 2 is a front elevation view of a flood flaps vent according to the present invention, shown during a flood event.
Figure 5:
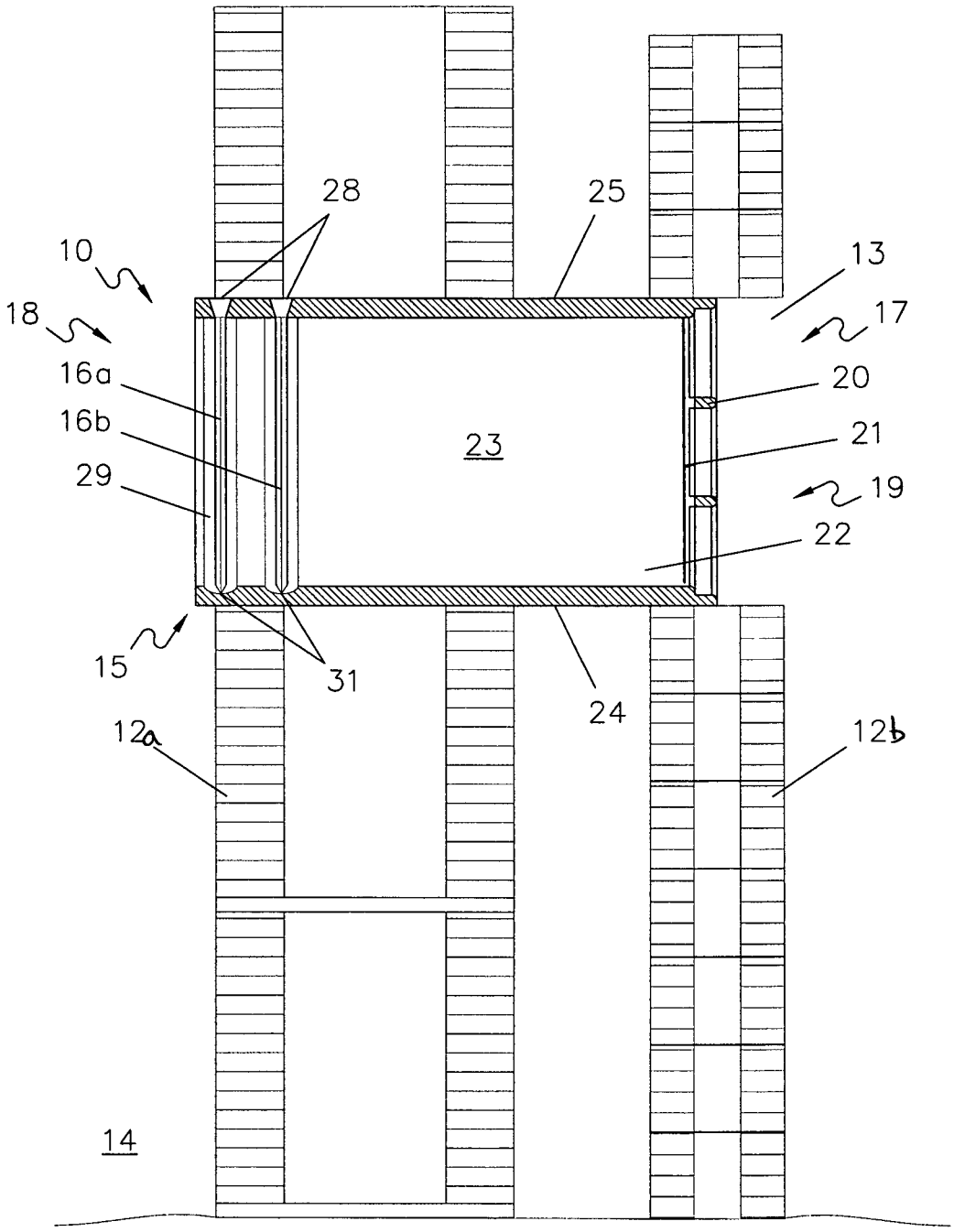
FIG. 5 is a side cross-sectional view of a flood flaps vent according to the present invention, shown installed in a building wall vent.

Turning first to FIGS. 1, 2, and 5, a flood flaps vent 10 fits closely into a correspondingly sized vent space 13 in a building wall 12 adjacent a crawlspace 14 under the building 11. The flood flap vents 10 are permanently fixed in the foundation walls of the building at an elevation above ground level. Flood flaps vents 10 are spaced apart around the lower part of a house or other building, usually about one vent for every hundred square feet or so of crawlspace (though this number varies). Often the front of the flood flaps vents 10 and the front wall of the house or other building can be seen from the street, with the flood flaps vents 10 all being at generally the same level on the building. As illustrated in FIG. 2, the decorative grills 20 on the front of the flood flaps vents 10 present a pleasing appearance from the street. As shown in FIG. 5, the crawlspace wall may include a brick wall 12*b* at the front of the flood flaps vent 10, and cement blocks 12*a* at the rear, often with spaces between.

The building 11 is a house, an office building, a warehouse, or any other type of building with a crawlspace. The flood flaps vents 10 are placed in the walls 12 of the crawlspace under a new building under construction, or they are retrofitted into the walls 12 of an existing building once the old vents have been removed. The building 11 may be designed and built with a sealed crawlspace under it, or an existing space under a building can be sealed to form a sealed crawlspace 14. The flood flaps vents 10 can be placed in all four walls 12 of a small house, for example, or just in a front wall and an opposite back wall of a building.

One or more dehumidifiers, which are usually controlled by a humidistat, are often placed inside the crawlspace 14 to keep the humidity at a controlled level. Flood flaps vents 10 have been found to help maintain a constant temp in the 60's (degrees Fahrenheit) within the crawlspace. Without meaning to be bound by theory, it is believed that flood flaps vents help control temperature and therefore heating and air conditioning costs in the home or other building 11 above the crawlspace 14. Growth of mold, fungus, and mildew is controlled in a sealed crawlspace equipped with flood flaps vents 10 and dehumidification, and wood under the building is less likely to rot or be damaged by insects. The flood flaps vents 10 largely discourage small animals, such as rats, opossums, cats, raccoons, moles, snakes, lizards, and some insects, from entering the sealed crawlspace.

As illustrated in FIGS. 1, 2 and 5, the flood flaps vent 10 includes: (a) a substantially box-shaped vent box portion 15 with opposite open ends 18, 19 on either end of the vent passageway 22; (b) at least one flood flap 16 extending across the open rear end 18 of the vent box portion 15; and (c) a grate portion 17 at the open front end 19 of the vent box portion 15. The opposite open ends 18, 19 of the vent box portion 15 are preferably each substantially rectangular-shaped. The front or rear end portion is the front or rear area, respectively, adjacent the end.

Crawlspace walls are most often brick and/or cement block. The vent box portion 15 is normally the height of a cement block, since it frequently replaces a cement block in a crawlspace wall. In an existing structure, a cement block is removed from a cement block building wall 12 adjacent the crawlspace and a flood flaps vent 10 is inserted into the vent space and sealed in.

The grate portion 17 includes the decorative grill 20 across its front end 19 and preferably a screen 21 directly behind the grill 20. The grate portion 17 preferably sits back about ¾ inch from the face of the house wall and presents a pleasing appearance to passers by. The screen 21 and grill 20 function to prevent mice, snakes, moles, etc., as well as larger animals, such as cats and rats, from entering the crawlspace to nest, eat, and breed. The screen 21 also traps debris and prevents it from entering the crawlspace. Although any suitable type of screen may be used, the screen 21 preferably has a grid of open squares, each with a grid size of up to about ½ inch for preventing debris intrusion yet permitting water to flow freely through it. The screen 21 is preferably molded or inserted inside the vent passageway 22 adjacent and behind the grill 20. The front face of the screen 21 preferably contacts the rear of the grill 20. The openings in the grill 20 are larger than the squares in the screen 21. The screen 21 is preferably made of aluminum or other metallic or fabric to prevent insects, other vermin, or debris from entering the crawlspace 14 under normal or flood conditions.

Alternatively, in the case of a retrofit, the grill 20 or the entire grate portion 17 can be removed from the flood flaps vent 10, which is then glued or otherwise attached to a grate of an existing house.

By "sealed crawlspace" herein is meant a space under a building with walls that have been segregated from the outside elements. The crawlspace is not necessarily hermetically sealed, just closed in as well as is feasible, as by adding insulation, sealing the floor and walls, and adding dehumidifiers to keep the crawlspace dry. By "sealing the crawlspace" herein is meant that, along with these other sealing measures taken, the flood flap vent 10 with its flood flap 16 helps to seal the building crawlspace 14.

By "flood plains" herein is meant flat or nearly flat land adjacent to oceans, streams or rivers, but also any land that is periodically exposed to flooding, even places where floods occur some 30-100 years apart.

With attention to FIGS. 1 through 5, the vent box portion 15 is comprised of two generally parallel side wall portions 23 connected at their bottom edges to opposite edges of a bottom box portion 24, and along their top edges to the opposite edges of a top box portion 25. All of the four portions 23-25 are generally rectangular in shape. The vent box portion 15 is preferably generally rectangular in cross-section. The vent box portion 15 is preferably one-piece and made of any suitable material, such as plastic or polyvinylchloride, most preferably molded recycled plastic The side wall portions 23 are preferably same sized and parallel to one another, and at right angles to the top and bottom box portions 24, 25. The top and bottom box portions 24, 25 are preferably same-sized and parallel to one another, and at right angles to the side wall portions 23. The outside corners of the vent box 15 are preferably square, though they may be rounded.

Although its size may vary, the vent box 15 is most preferably about 12 inches deep, its size being determined by the size of a cinder block, since the flood flaps vent 10 replaces one cinder block. The flood flaps vent 10 is preferably (but not limited to) about 8 inches by 16 inches by 12 inches. A second size is about 16 inches by 16 inches by 12 inches. In the case of a brick building wall, which is generally thinner than a cinder block wall, a rear part of the flood flaps vent 10 simply sticks out into the crawlspace 14.

With continued attention to FIGS. 1 through 5, while the front end 19 of the vent box 15 is covered by the grate portion 17, the open rear end 18 is covered by at least one, and preferably two or three, flood flaps 16. Without meaning to be bound by theory, it is believed that one flood flap 16 is sufficient for use in temperate climates. In a majority of climates, two flood flaps 16 covering the rear end 18 of the box 15 are optimal. Double flood flaps 16 provide thermal insulation that is consistent with the insulation of the interior crawlspace walls. (Insulation is installed on the crawlspace walls as part of the sealing process.) Where winter or summer temps are consistently excessive (e.g., extreme northern climes, desert locales), three flood flaps 16, one behind and parallel to the next, are preferred for the additional insulation they provide. Three flood flaps help regulate the temperature in the sealed crawlspace 14 and yet permit flood waters to pass through the crawlspace 14 in the event of a flood.

Each flood flap 16 extends down substantially vertically from the top box portion 25 of the vent box 15, as seen in FIGS. 3-10. Where the flood flaps vent 10 has two flood flaps 16, the top box portion 25 includes two parallel flap slots 27 that extend almost from one side edge to almost the opposite side edge of the top box portion 25 over the otherwise open rear end 18 of the vent box 15. The flap slots 27 are preferably rectangular-shaped (looking down from above), with short side edges. The rearmost slot 27*a* is preferably about an inch or two from the rear end 18 of the flood flaps vent 10 for strength.

Figure 8:
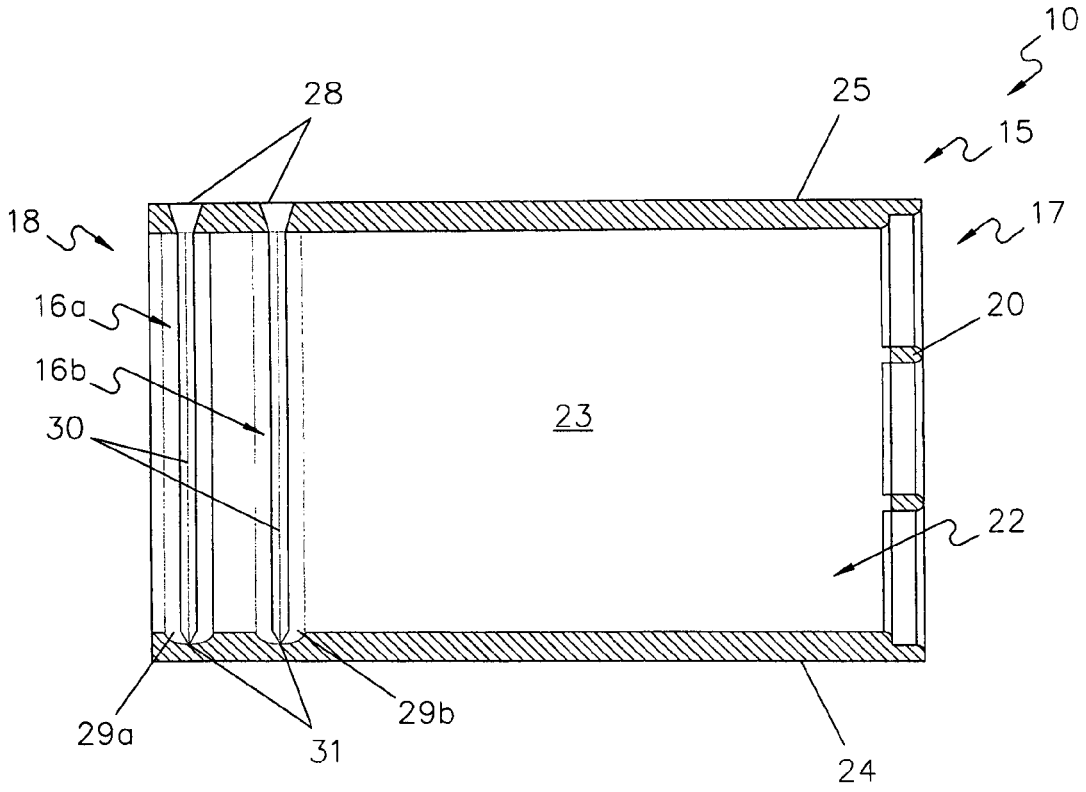
FIG. 8 is an enlarged side cross-sectional view of the flood flaps vent according to FIG. 5.
Figure 9:
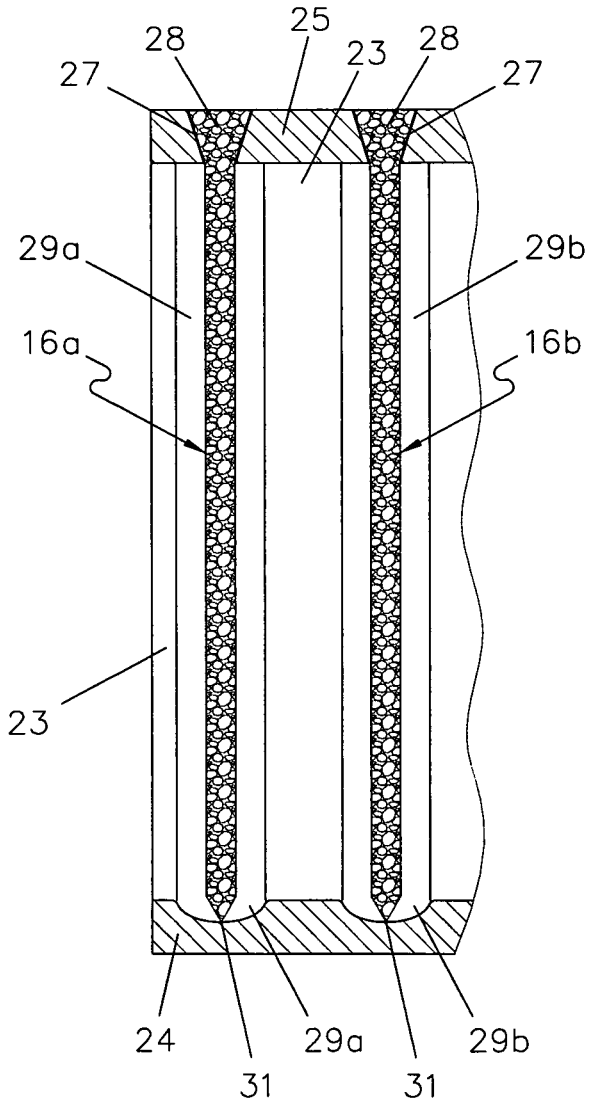
FIG. 9 is a side cross-sectional view of the flood flaps of the flood flaps vent according to FIG. 1.
Figure 10:
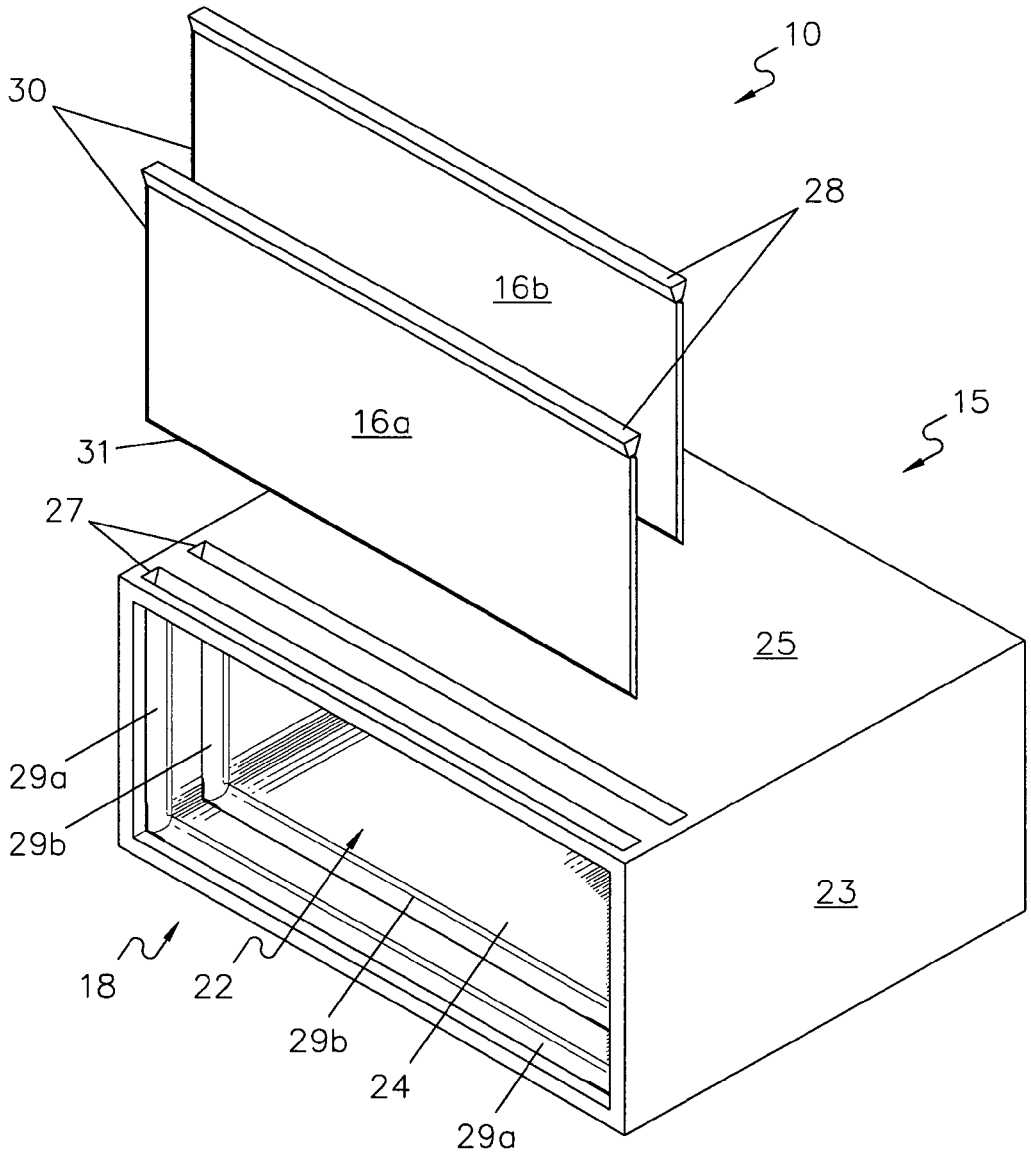
FIG. 10 is a rear perspective view of a flood flaps vent according to the present invention, shown with detached flood flaps.

As seen in FIGS. 8-10, each flood flap 16 preferably includes a thickened upper flap wedge 28 that extends along the top of each flood flap 16. The upper flap wedge 28 is preferably generally triangular in cross-section, as seen in FIGS. 9 and 10. To assemble the flood flaps vent 10, the body of each flood flap 16 slides down through the flap slot 27 as seen in FIG. 10. The flap slot 27 is also generally triangular, or wedge-shaped, in cross-section, so that the flap wedge 28 catches in the flap slot 27, as seen in FIG. 9. Thus, the flood flap 16 hangs in the flap slot 27, suspended by the flap wedge 28 in the flap slot 27. The flood flap 16 need not be glued into place within the flood flaps vent 10.

The flood flap 16 is the about the same size as the passageway 22 at the rear end 18 of the vent box 15. The other three side edges 30, 31 of the generally rectangular-shaped flood flap 16 are preferably sharp-edged, as seen in FIGS. 8-10. The three free edges 30, 31 of the flood flap 16 preferably contact the inside of the vent box 15. The flood flaps 16 are preferably the exact size of the rear end opening so as to prevent air from passing through from the vent passageway 22 into the crawlspace 14.

The vent box portion 15 preferably includes at least one and preferably two wall flap channels 29 carved into the inside faces of the two opposite side wall portions 23, and the bottom box portion 24 between them, in the area of the box rear end 18. The term "side flap edges" herein is meant to include the side edges 30 and the bottom edge 31 of the flood flap 16. The side flap edges 30 of each flood flap 16 fit into the opposite side sections of the corresponding flap channel 29. The bottom flap edge 31 of the flood flap 16 fits into the central section of the flap channel 29, as seen in FIG. 9. The side sections of the flap channel 29 are continuous with the central section of that flap channel. The three free edges 30, 31 of the outer flood flap 16*a* fit into the outermost flap channel 29*a*, and the three free edges 30, 31 of the inner flood flap 16*b* fit into the innermost flap channel 29*b*. By "free" is meant that the edges 30, 31 are not attached to any structure, which permits the flood flap 16 to flap in and out with water entering or exiting the flood flaps vent 10 during, for example, a flood.

Figure 3:
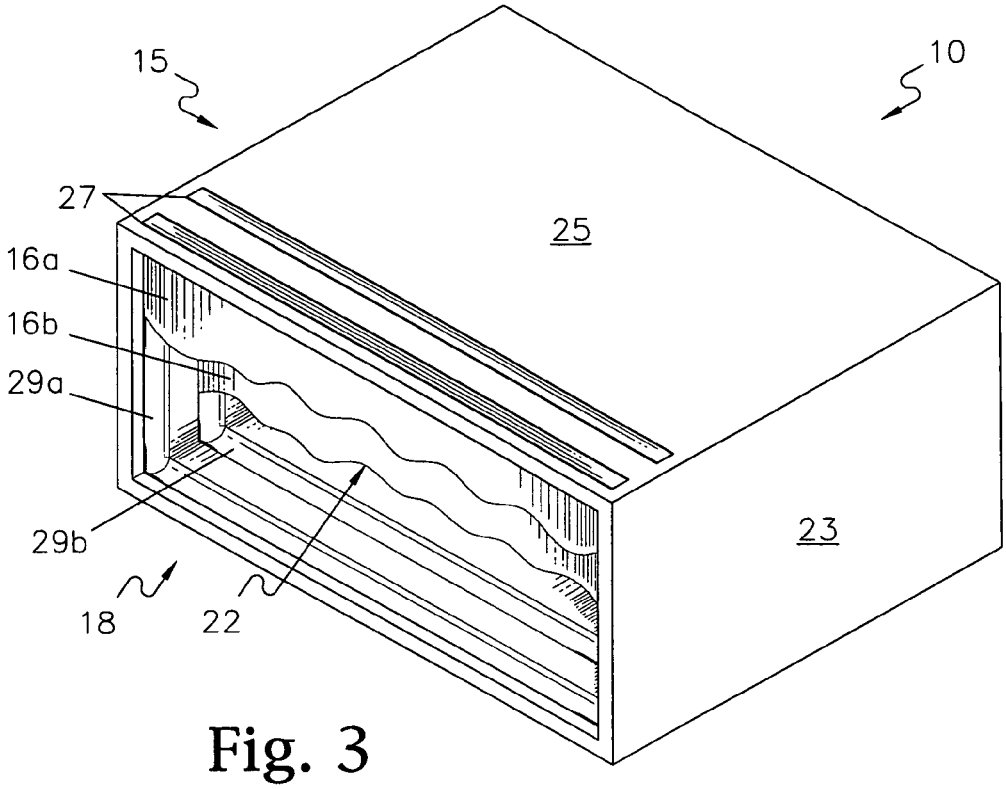
FIG. 3 is a rear perspective view of a flood flaps vent according to the present invention, shown with the flood flaps cut away for purposes of illustration.
Figure 4:
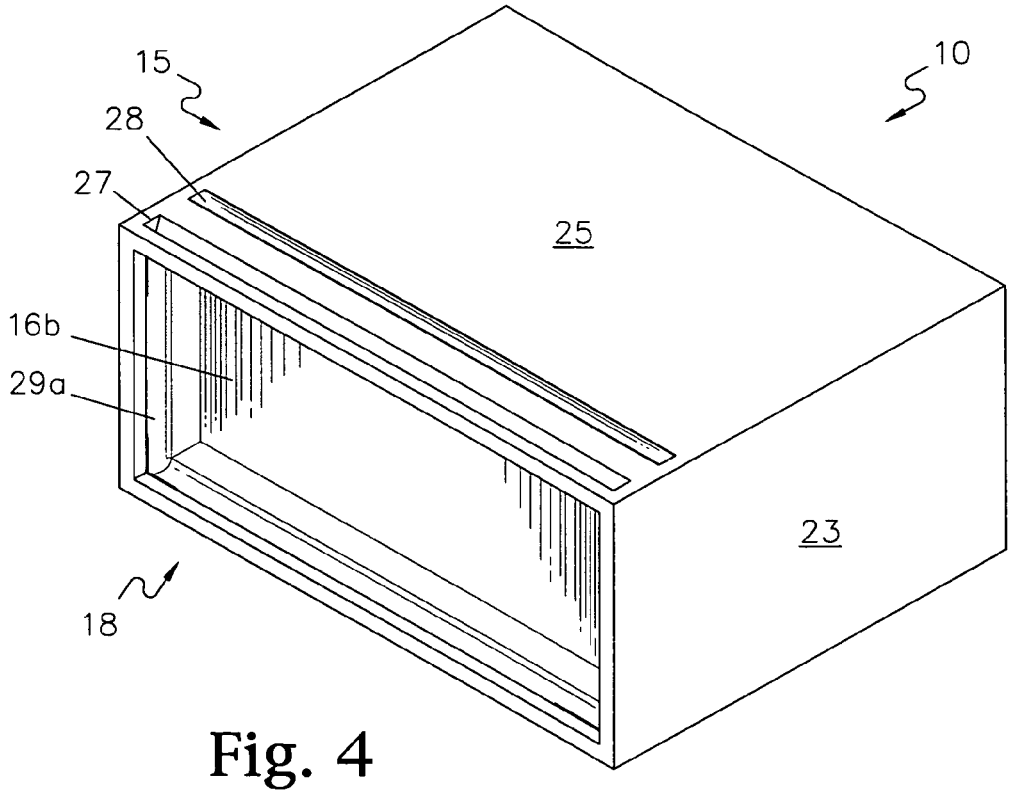
FIG. 4 is a rear perspective view of a flood flaps vent according to the present invention, shown without an outer flood flap for purposes of illustration.

The flap channel 29 helps maintain a home position for the free edge 30, 31 of the flood flap 16 that fits into the flap channel 29, protecting the flood flap from windy conditions. Even though its three flap edges 30, 31 rest in the flap channel 29, the flexible flood flap 16 is capable of swinging from the top flap edge, which is preferably a flap wedge 28, in the vent passageway 22. The base of the flap channel 29 is preferably curved as seen in FIGS. 3, 5 and 9 in order to facilitate movement of the flood flap edges 30, 31 into and out of the flap channel 29. The base of the flap channel 29 is less preferably substantially flat with relatively straight sides parallel to one another bordering the channel base. The free flap edges 30, 31 in the flap channels 29 help seal the rear vent opening.

The flood flaps 16 are made of a durable material, such as rubber or vinyl sponge, that is flexible enough to resist air flow, thick enough to provide insulation, and strong enough to keep rodents and other vermin out, yet allow water flow under flood conditions. The flood flap material is preferably a molded, spongy material with a non-porous, semi-rigid skin sealed to the spongy material. It may be buoyant so that the body of the flood flap 16 is easily pushed upward by flood waters. Air bubbles are preferably entrained (suspended) in the flood flaps (see FIG. 9) for buoyancy. If a flood flaps vent 10 is already in a crawlspace wall, the material is flexible enough to permit a flood flap 16 to be replaced from inside a vent box 15, if necessary on rare occasions. To do so, the upper flap wedge 28 at the top of the flood flap 16 is squeezed, inserted into the flap slot 27, and released. The three side edges 30, 31 of the body of the flood flap 16 find a home in the corresponding flap channel 29, which is next to and below them. When the flood flaps 16 are in the substantially vertical, resting position (steady state), the side edges 30, 31 of the body of the flood flap 16 are seated in the corresponding flap channel 29.

Although the thickness of the flood flap 16 may vary, it has been found herein that a preferred thickness of between about ¼ and ½ inch is optimal for providing insulation. In their vertical, at rest positions, the inner flood flap 16*b* is not in contact with the outer flood flap 16*a*. Importantly, the flood flaps 16 are preferably between about ½ inch and about two inches (most preferably about an inch) apart so the air space between them provides additional insulation (see FIG. 5). The insulating flood flaps 16 help to seal the crawlspace. The width of the flap wall channel 29 is preferably about twice the thickness of the flood flap 16 in order to help the flood flap 16 slide into home (resting) position in the wall channel 29.

Alternatively and less preferably, the upper edge of the flood flap 16 is attached within its flap slot 27 in the top box portion 25. The upper flap edge 28 is less preferably squared in a conventional manner, or sharp-edged like the other three, unattached flap edges 30, 31 as described herein. To insert the upper flap edge in the flap slot 27 when the flood flaps vent 10 is being made, the upper flap edge is squeezed, inserted into the flap slot 27, and released. Since it is made of a foam-like material, the upper flap edge expands back out again once it is inserted, which holds it in the flap slot 27. This is another advantage of the flood flap 16 being made of sponge vinyl or the like. Once it is in the flap slot 27, the upper edge of the flood flap 16 may be attached in the slot, as by gluing.

Figure 11:
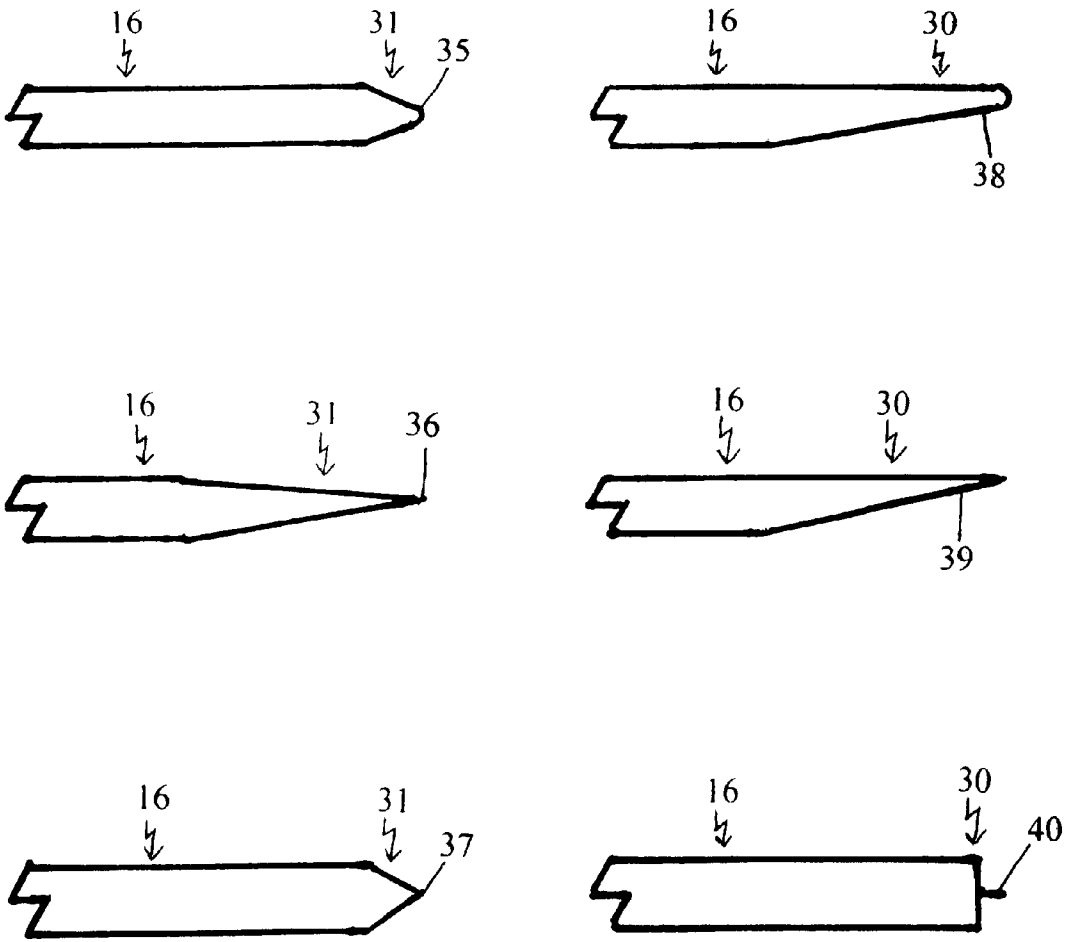
FIG. 11 shows six alternate side views of a free edge of a flood flap of a flood flaps vent according to the present invention.

The three (free) edges 30, 31 of the flood flap 16 are less preferably substantially squared off, or flat. They preferably have a sharp, tapered edge shape, though, for optimal functioning. As seen in FIGS. 8, 10, and 11, the unattached edges 30, 31 preferably have the same shape/appearance as one another, and one of six alternate shapes. Moving down from the upper left of FIG. 11, the free edge 30 or 31 is: rounded 35, with the round at the center of the edge 30, 31; knife-edged 36 (preferred); or pointed 37. Moving down from the upper right of FIG. 11, the free edge 30 or 31 can be an off-center rounded edge 38 (most preferred); an off center knife edge 39; or a blade edge 40. It has been found herein that these sharper edges 35-40 glide more easily into and out of the flap channel 29, permitting the flaps to quickly find the home (at rest) position and helping to seal the flood flaps vent 10.

Figure 6:
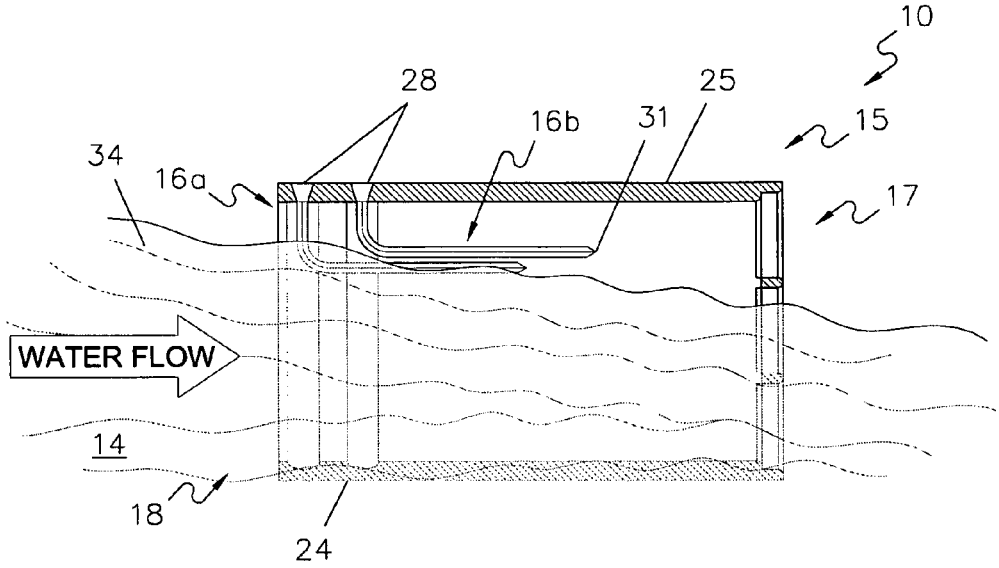
FIG. 6 is a side cross-sectional view of a flood flaps vent according to the present invention, shown with flood water flowing through the flood flaps vent out of the crawlspace.
Figure 7:
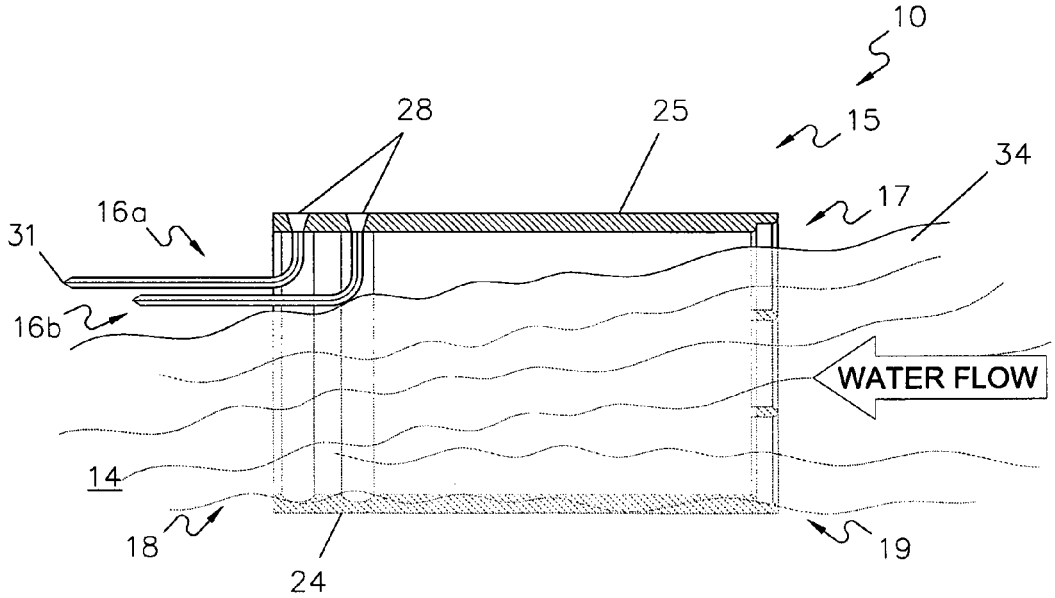
FIG. 7 is a side cross-sectional view of a flood flaps vent according to the present invention, shown with flood water flowing into the crawlspace.

Flood events are mercifully few and far between in most places. However, when flood waters do rise, incoming flood water 34 pushes the flood flaps 16, as seen in FIG. 7. The flood water 34 surges through the grill 20 and screen 21 at the front end 19 of the flood flaps vent 10, through the vent passageway 22, by the flood flaps 16, and out the rear end 18 of the vent box 15. As the water rushes by the flexible flood flaps 16, it pushes the bodies of the flood flaps 16*a*, 16*b* up and out of the way. (By "bodies of the flood flaps" herein is meant all but the top edges of the flood flaps.) The flexed, sideways "L" shape of the flood flaps 16 seen in FIGS. 6 and 7 is their open "flood position" (versus their generally vertical, closed, at rest position). The upper flap wedges 28 hold the flood flaps in the flap slots 27, so the flood flaps 16 are not pulled out of the flood flaps vent 10. The flood flaps 16 do not impede the rush of water into or out of the crawlspace 14. Since the flood flaps 16 are not blocking the rear end vent opening, the hydrostatic pressure under the building is unlikely to build, so it is less likely that the building walls 12 will be weakened or toppled by the flood event.

As seen in FIG. 6, flood water 34 escaping from the crawlspace 14 passes through the open rear end 18 of the flood flaps vent 10, past the flood flaps 16, through the vent passageway 22, through the screen 21 and grill 20 of the grate portion 17 and out the open front end 19 of the flood flaps vent 10. The flood flaps 16 are preferably separated from but close to one another, and close to the rear end 18 of the vent box 15, and the flood flaps vent 10 is sufficiently long to accommodate the body of the flood flaps 16, so that the bottom ends 31 of the flood flaps 16 will not push up against the grate portion 17 during a flood event. (By "body" of the flap is meant all but the top edge 28.) Double flood flaps 16 are preferably between about ½ inch and about two inches apart, most preferably about one inch apart from one another, in a flood flaps vent 10.

In a less preferred flood flaps vent with three flood flaps 16, the vent box potion 15 is sufficiently long (deeper) to accommodate the length of the innermost flood flap 16. The triple flap vent has three substantially parallel flap slots 27. At rest, the three flood flaps 16, which hang down into the passageway 22, are all substantially parallel to one another, resembling the double flap shown in FIG. 10, but with an additional flap slot 27 adjacent the innermost slot 27 and a third flood flap 16*c* in the flap slot behind the second flap 16*b*.

The flood flap material is flexible enough to be moved in either direction (in as in FIG. 6 or out as in FIG. 7) by slight water pressure. The sturdy flood flaps 16 are sufficiently flexible to return to their vertical, "sealed", resting, home position (see FIG. 5) and dry out once the flood subsides. The flood flaps vent 10 is useful for those buildings in flood plains or other locations exposed to the possibility of high water (e.g., during hurricanes, dam breaks), such as buildings by rivers, creeks, lakes, the ocean, or downstream from dams. The length and height of the flood flap 16 is approximately the length and height of the vent passageway interior.

For some applications, such as garage walls where horizontal space is limited, two flood flaps vents 10 can be stacked on top of one another in place of two stacked cinder blocks in a wall. Homeowners are sealing/insulating their garages more frequently now, for example, where they are storing furniture, documents, sports equipment, musical instruments, etc. in their garages and therefore want them temperature controlled.

Figure 12:
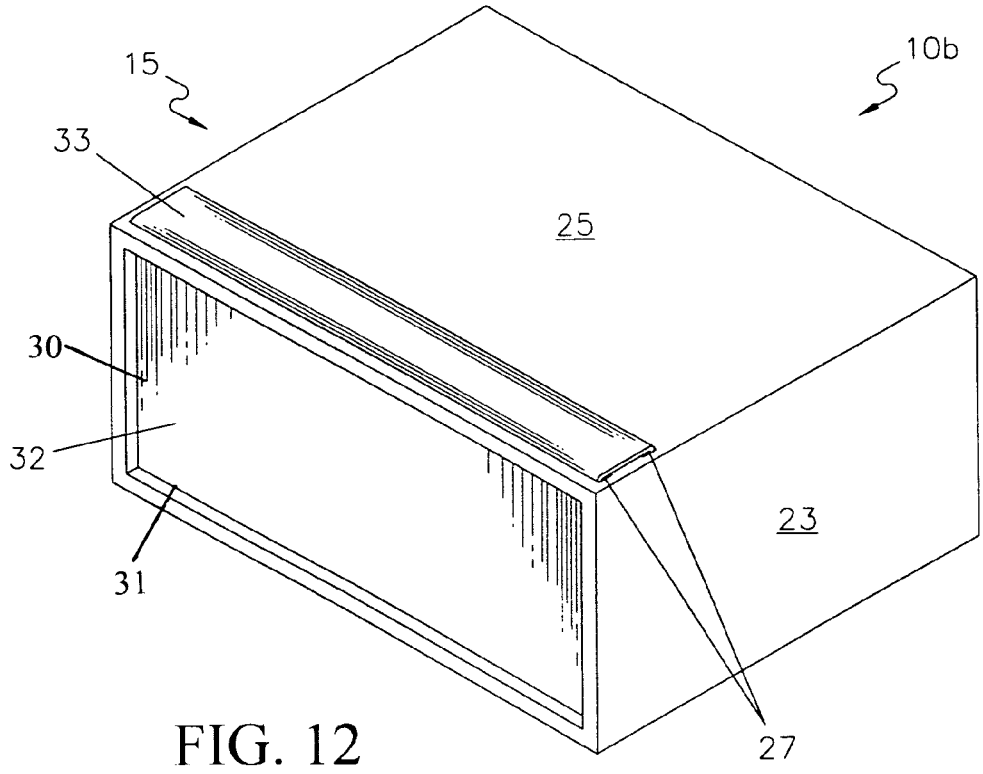
FIG. 12 is a rear perspective view of a flood flaps vent according to the present invention, shown with a single flood flap sheet.

In FIG. 12, a single, wrap-around flood flap 32 is employed rather than two separate flood flaps 16 as described above. The less preferred single flood flap sheet 32 is about twice the height of two shorter flood flaps 16, with an additional, continuous, center flood flap piece 33 that loops through the parallel flap slots 27 in the top box portion 25 of the vent box 15. Thus, the single flood flap sheet 32 hangs over the piece of the top box portion 25 between the flap slots 27 like a quilt over a quilt rack. One end portion of the single flood flap sheet 32 hangs behind the other (like a double flap). The length of the single flood flap 32 is the same as the shorter flood flaps 16 described hereinabove. The bottom flap edges 31 of the single flood flap 32, which are actually opposite ends of the single flood flap 32, preferably contact the inside bottom box portion 24. In the resting, home position (see FIG. 12) then, each end portion of the single flood flap 32 blocks the vent passageway 22. Otherwise, the vent box 15 and grate portion 17 of this flood flap vent 10*b* are as described herein.

Thus, the flood flaps vent 10*b* seen in FIG. 12 includes: (a) a vent box portion 15 with opposite open front and rear end portions 18, 19 on either end of a vent passageway 22 in the vent box portion 15, the vent box portion 15 including a top box portion 25 and an opposite bottom box portion 24, the top box portion 25 including two substantially parallel flap slots 27 in a rear end portion 18 of the vent box portion 15, with a section of the top box portion 25 between the two flap slots 27; (b) a single flexible flood flap sheet 32 comprising a center flood flap piece 33 continuous with two same-sized end flap portions on either side of the smaller center flood flap piece 33, the center flood flap piece 33 contacting an upper surface of the section of the top box portion 25 between the two flap slots 27, the end flap portions each hanging down freely from one of the flap slots 27, the end flap portions occluding the rear end portion 18 of the vent box portion 15; and (c) a grate portion 17 over the open front end portion 19 of the vent box portion 15.

The vent box portion 15 of the single sheet flood flaps vent 10*b* of FIG. 12 preferably includes two opposite side wall portions 23, the top box portion 25 and the bottom box portion 24 being connected by the two opposite side wall portions 23. When the single flood flap sheet 32 is in the resting position, bottom flap edges 31 of each end flap portion contact an inside surface of the bottom box portion 24, and opposite side flap edges 30 of each end flap portion contact an inside surface of one of the side wall portions 23. This flood flap vent 10*b* may or may not include flap channels 29 as described herein. One end portion of the single flood flap sheet 32 hangs behind the other, occluding the vent passageway 22. An underside of the center flood flap piece 33 is attached, as by gluing, to the upper surface of the top box portion piece between the flap slots 27. Only the center flood flap piece 33 is visible from the top of the flood flaps vent 10*b*. The bottom and side flap edges 30, 31 of the single flood flap sheet 32 are preferably sharp as seen in FIG. 11 as described herein.

From the foregoing it can be realized that the described device of the present invention may be easily and conveniently utilized as a flood flaps vent for sealing a crawlspace under a building. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 flood flaps vent
11 building
12*a* building wall (blocks)
12*b* building wall (bricks)
13 vent space
14 crawlspace
15 vent box
16 flood flap
17 grate portion
18 rear end of vent box
19 front end of vent box
20 grill
21 screen
22 vent passageway
23 side wall portions
24 bottom box portion
25 top box portion
27 flap slot
28 upper flap wedge
29 wall flap channel
30 side flap edges
31 bottom flap edge
32 wrap-around flood flap
33 centerpiece of wrap-around flood flap
34 flood waters
35 flap center rounded edge
36 knife-edged flap
37 pointed edge flap
38 off-center rounded edge flap
39 off-center knife edge flap
40 blade edge flap

What is claimed is:

1. A flood flaps vent for sealing a building crawlspace, the flood flaps vent comprising:

(a) a vent box portion comprising open opposite front and rear ends on either end of a vent passageway in the vent box portion, the vent box portion comprising a top box portion, an opposite bottom box portion, and two side wall portions, the top box portion comprising at least one flap slot adjacent a rear end portion of the vent box portion;

(b) at least one flexible flood flap extending across the open rear end portion of the vent box portion, an upper edge of the at least one flexible flood flap being seated in the correspondingly sized at least one flap slot, other side flap edges of the flexible flood flap being unattached; and (c) a grate portion over the open front end of the vent box portion; wherein the at least one flexible flood flap substantially occludes the rear end portion of the vent box portion when the at least one flexible flood flap is in an at rest, home position; and wherein the at least one flap slot is elongated and in the top box portion, with an upper portion of the flexible flood flap inserted therethrough.

2. The flood flaps vent according to claim 1, wherein the at least one flexible flood flap is substantially rectangular in shape and comprises three of the unattached side flap edges, the vent box portion further comprising at least one flap channel in the rear end portion of the vent box portion.

3. The flood flaps vent according to claim 2, wherein the three unattached side flap edges of the at least one flexible flood flap are each seated in a corresponding one of the flap channels when the at least one flexible flood flap is in the at rest, home position.

4. The flood flaps vent according to claim 2, comprising two flexible flood flaps, two flap slots, and two flap channels, all in the rear end portion of the vent box portion, each flap channel corresponding to one of the flexible flood flaps, the top box portion being substantially parallel to the bottom box portion, and the two side wall portions being same sized and substantially parallel to one another, each flap channel extending along an inside of the side wall portions and the bottom box portion, each flap channel being concave on cross-section.

5. The flood flaps vent according to claim 1, wherein the upper edge of the at least one flexible flood flap is substantially wedge-shaped, the at least one flap slot being correspondingly shaped.

6. The flood flaps vent according to claim 4, wherein the grate portion comprises a grill at the open front end of the vent box portion and a screen behind and adjacent the grill.

7. The flood flaps vent according to claim 4, wherein, when the flexible flood flaps are in the at rest, home position, opposite side edges of each flexible flood flap fit into opposite side sections of the corresponding flap channel in the inside side wall portions of the vent box portion, and a bottom flap edge of the flexible flood flap fits into a central section of the flap channel in the inside bottom box portion of the vent box portion, the three sections of the flap channel being continuous with one another.

8. The flood flaps vent according to claim 1, wherein there are two same-sized, spaced apart flexible flood flaps, each flexible flood flap being rectangular-shaped and comprising three sharp, tapered unattached flap edges.

9. A flood flaps vent for sealing a building crawlspace, the flood flaps vent comprising: (a) a vent box portion comprising open opposite front and rear ends on either end of a vent passageway in the vent box portion, the vent box portion comprising a top box portion, an opposite bottom box portion, and two side wall portions, the top box portion comprising at least one flap slot; (b) at least one flexible flood flap extending across the open rear end portion of the vent box portion, an upper edge of the at least one flexible flood flap being seated in the correspondingly sized at least one flap slot, other side flap edges of the flexible flood flap being unattached; and (c) a grate portion over the open front end of the vent box portion; wherein the at least one flexible flood flap substantially occludes the rear end portion of the vent box portion when the at least one flexible flood flap is in an at rest, home position; and wherein at least one of the flood flap edges is received by a flap channel within the vent box portion when the at least one flood flap is in the at rest, home position.

10. The flood flaps vent according to claim 9, wherein the upper edge of the at least one flexible flood flap is substantially wedge-shaped in cross-section, the at least one flap slot being correspondingly shaped in cross-section.

11. The flood flaps vent according to claim 9, wherein the at least one flexible flood flap comprises three of the unattached side flap edges, and the three unattached side edges of the flexible flood flaps are each rounded with a round at the center of the free edge, or have an off-center rounded edge.

12. The flood flaps vent according to claim 9, wherein the at least one flexible flood flap comprises three of the unattached side flap edges, a bottom one of the unattached side flap edges being knife-edged.

13. The flood flaps vent according to claim 9, wherein the at least one flexible flood flap comprises three of the unattached side flap edges, each unattached side flap edge being a blade edge.

14. The flood flaps vent according to claim 9, wherein the at least one flexible flood flap comprises three of the unattached side flap edges, each unattached side flap edge being pointed.

15. The flood flaps vent according to claim 9, wherein there are two same-sized, spaced apart flexible flood flaps, each flexible flood flap being rectangular-shaped, each of the unattached flap edges, bottom edge, and two opposite side edges, being tapered.

16. The flood flaps vent according to claim 9, comprising three flexible flood flaps, three flap slots, and three flap channels, each flap channel corresponding to one of the flexible flood flaps, the top box portion being substantially parallel to the bottom box portion, and the two side wall portions being same sized and substantially parallel to one another, each flap channel extending along an inside of the side wall portions and the bottom box portion.

17. A single sheet flood flaps vent for sealing a building crawlspace, the single sheet flood flaps vent comprising:

(a) a vent box portion with opposite open front and rear ends on either end of a vent passageway in the vent box portion, the vent box portion comprising a top box portion, an opposite bottom box portion, and two opposite side wall portions, the top box portion comprising two substantially parallel flap slots in a rear end portion of the vent box portion, with a section of the top box portion between the two flap slots;

(b) a single flexible flood flap sheet comprising a horizontal center flood flap section continuous with two same-sized end flap portions on opposite sides of the smaller center flood flap section, the horizontal center flood flap section contacting a horizontal upper surface of the section of the top box portion between the two flap slots, the end flap portions each hanging down freely from one of the flap slots, the end flap portions occluding the rear end portion of the vent box portion; and (c) a grate portion over the open front end portion of the vent box portion; wherein the two substantially parallel flap slots are each elongated and in the top box portion, with the flood flap sheet inserted through each of the two substantially parallel flap slots.

18. The flood flaps vent according to claim 17, wherein the top box portion and the bottom box portion are connected by the two opposite side wall portions, the two opposite side wall portions being same-sized and substantially parallel to one another; and wherein, when the flexible flood flap sheet is in an at rest, home position, bottom flap edges of each end flap portion contact an inside surface of the bottom box portion, and opposite side flap edges of each end flap portion contact an inside surface of one of the side wall portions, the end flap portions being substantially the same-size.

19. The flood flaps vent according to claim 18, wherein one end portion of the single flexible flood flap sheet hangs behind the other, occluding the vent passageway; and wherein at least one of the flap edges is received by a flap channel within the vent box portion when the flexible flood flap sheet is in the at rest home position.

20. The flood flaps vent according to claim 17, wherein an underside of the horizontal center flood flap piece is attached to the horizontal upper surface of the top box portion piece between the flap slots.

* * * * *